US007165594B2

(12) United States Patent
Senesac et al.

(10) Patent No.: US 7,165,594 B2
(45) Date of Patent: Jan. 23, 2007

(54) REMOVABLE DECORATIVE VANE COVER

(75) Inventors: Wayne M. Senesac, Oxford, IN (US); Polet Senesac, Oxford, IN (US)

(73) Assignee: Oxford House, Incorporated, Oxford, IN (US)

( * ) Notice: Subject to any disclaimer, the term of this patent is extended or adjusted under 35 U.S.C. 154(b) by 373 days.

(21) Appl. No.: 10/812,823

(22) Filed: Mar. 29, 2004

(65) Prior Publication Data

US 2004/0177932 A1 Sep. 16, 2004

Related U.S. Application Data

(63) Continuation-in-part of application No. 10/103,483, filed on Mar. 22, 2002, now Pat. No. 6,786,269.

(51) Int. Cl.
*E06B 9/262* (2006.01)

(52) U.S. Cl. ..... 160/89; 160/178.1 V

(58) Field of Classification Search ..... 160/178.1 V, 160/168.1 V, 900, 89, 236, 237, 173 V, DIG. 7; 24/716

See application file for complete search history.

(56) References Cited

U.S. PATENT DOCUMENTS 1,817,716 A * 8/1931 Stam ..... 139/416
2,037,629 A * 4/1936 Holgate ..... 160/237
2,079,831 A * 5/1937 Bauer, Jr. et al. ..... 139/389
2,125,422 A * 8/1938 Bosworth ..... 139/383 R
2,828,816 A * 4/1958 Nestor ..... 160/176.1 V
2,874,772 A 2/1959 Dwyer et al.
3,106,240 A 10/1963 Weber
3,696,845 A * 10/1972 Acker et al. ..... 139/383 R
3,844,330 A 10/1974 Hyman
3,851,699 A * 12/1974 Shapiro ..... 160/168.1 V
3,946,789 A * 3/1976 Ronkholz-Tolle, nee Tolle ..... 160/168.1 R
3,999,590 A 12/1976 Koch (Continued)

FOREIGN PATENT DOCUMENTS

JP 10245753 A2 9/1998

(Continued)

OTHER PUBLICATIONS

Hunter Douglas Window Fashions Brochure, Custom Vertical Blinds, © 2001.

(Continued)

*Primary Examiner*—David Purol
(74) *Attorney, Agent, or Firm*—Woodard, Emhardt, Moriarty, McNett & Henry LLP

(57) ABSTRACT

A blind system includes a first blind vane having an edge portion and a second blind vane having an edge portion. The system includes a cover that forms a u-shaped fold that extends between the first vane and the second vane. A first reattachable fastener detachably couples the cover to the first vane at the edge portion of the first vane. The first fastener is constructed and arranged to allow the cover to be detached and reattached to the first vane. A second reattachable fastener detachably couples the cover to the second vane at the edge portion of the second vane. The second fastener is constructed and arranged to allow the cover to be detached and reattached to the second vane.

36 Claims, 8 Drawing Sheets

U.S. PATENT DOCUMENTS

| | | | | |
|---|---|---|---|---|
| 4,007,763 | A | | 2/1977 | Sellers et al. |
| 4,049,038 | A | | 9/1977 | Hyman et al. |
| 4,054,703 | A | | 10/1977 | Boehm |
| 4,142,570 | A | | 3/1979 | Heimberg |
| 4,377,195 | A | | 3/1983 | Weil |
| 4,529,025 | A | * | 7/1985 | Oskam ..... 160/178.1 V |
| 4,049,038 | A | | 9/1989 | Hyman et al. |
| 4,911,220 | A | | 3/1990 | Hiller |
| 4,972,895 | A | | 11/1990 | Meshaka |
| 5,012,552 | A | | 5/1991 | Wulf |
| 5,078,668 | A | | 1/1992 | Endres |
| 5,101,876 | A | * | 4/1992 | Zak ..... 160/236 |
| 5,142,703 | A | | 9/1992 | Basinger et al. |
| 5,191,922 | A | | 3/1993 | Wade |
| 5,249,617 | A | | 10/1993 | Dürig |
| 5,297,607 | A | | 3/1994 | Beauchamp |
| 5,392,833 | A | | 2/1995 | Ohanesian |
| 5,439,042 | A | | 8/1995 | Ohanesian |
| 5,490,553 | A | | 2/1996 | Colson et al. |
| 5,543,196 | A | | 8/1996 | Robinson et al. |
| 5,603,369 | A | | 2/1997 | Colson et al. |
| 5,626,177 | A | | 5/1997 | Colson et al. |
| 5,638,880 | A | | 6/1997 | Colson et al. |
| 5,638,881 | A | | 6/1997 | Ruggles et al. |
| 5,713,407 | A | | 2/1998 | Judkins |
| 5,715,883 | A | | 2/1998 | Keith |
| 5,749,404 | A | | 5/1998 | Colson |
| D397,571 | S | | 9/1998 | Anthony et al. |
| 5,819,833 | A | | 10/1998 | Swiszcz et al. |
| 5,845,690 | A | | 12/1998 | Colson et al. |
| 5,876,545 | A | | 3/1999 | Swiszcz et al. |
| 6,142,210 | A | | 11/2000 | Isoda |
| 6,164,363 | A | | 12/2000 | Colson et al. |
| 6,170,548 | B1 | | 1/2001 | Swiszcz et al. |
| 6,182,739 | B1 | | 2/2001 | Jones |
| 6,186,213 | B1 | * | 2/2001 | Senesac ..... 160/89 |
| D444,698 | S | | 7/2001 | Anderson |
| 6,334,477 | B1 | | 1/2002 | Moir |
| 6,397,920 | B1 | * | 6/2002 | Forin ..... 160/238 |
| 6,474,396 | B1 | | 11/2002 | Toder |
| 6,510,885 | B1 | | 1/2003 | Shih |
| 6,675,858 | B2 | * | 1/2004 | Marocco ..... 160/89 |
| 2003/0051823 | A1 | * | 3/2003 | Nien ..... 160/89 |

FOREIGN PATENT DOCUMENTS

| | | |
|---|---|---|
| JP | 2000008241 A2 | 1/2000 |
| WO | WO 96/35855 | 11/1996 |

OTHER PUBLICATIONS

Hunter Douglas Window Fashions Brochure, Luminette Privacy Sheers, © 2000.

* cited by examiner

REMOVABLE DECORATIVE VANE COVER

REFERENCE TO RELATED APPLICATIONS

The present application is a continuation-in-part of U.S. patent application Ser. No. 10/103,483, filed Mar. 22, 2002, now U.S. Pat. No. 6,786,269, which is hereby incorporated by reference in its entirety.

BACKGROUND OF THE INVENTION

The present invention generally relates to blind systems, and more specifically, but not exclusively, concerns a blind cover that is detachably coupled to a plurality of vanes so that the vane cover can be removed when needed.

A common covering system for windows, sliding glass doors and other types of openings are vertical blinds. The vertical blinds have vanes, which are rotatable about a vertical axis in order to open or close the blind. A current popular feature is to integrally form the vanes with a cover that extends across the vanes so as to diffuse incoming light and to provide an aesthetically pleasing appearance. One popular vane cover design is the u-shaped or scalloped design in which the cover forms folds between the vanes that extend in outward direction towards the viewer. Such covers typically include vanes made of a stiff fabric that are integrally attached together with strips of sheer fabric. One problem with such covers is that the material used to form the cover is expensive, and the manufacturing cost for the covers is likewise expensive. Furthermore, the stiffening and sheer fabrics are not washable in conventional washing machines. If washed in a conventional washing machine, the fabrics in the cover would be destroyed by the washing process. The washing process bends the stiffening fabric such that the stiffening vanes are no longer straight after washing. Another problem faced with the integral cover design is that the stiffening fabric does not have enough weight in order to counter balance the weight of the u-shaped folds. This creates an undesirable "swooped back" look in which the lower part of the cover angles back towards the window. Moreover, retrofitting such an integral vane system to pre-existing vertical blind systems can be quite expensive.

SUMMARY OF THE INVENTION

One form of the present invention concerns a unique vertical blind cover system and method of manufacturing such a system.

A system according to a further form of the present invention includes a first blind vane having an edge portion and a second blind vane having an edge portion. The system includes a cover that forms a u-shaped fold that extends between the first vane and the second vane. A first reattachable fastener detachably couples the cover to the first vane at the edge portion of the first vane. The first fastener is constructed and arranged to allow the cover to be detached and reattached to the first vane. A second reattachable fastener detachably couples the cover to the second vane at the edge portion of the second vane. The second fastener is constructed and arranged to allow the cover to be detached and reattached to the second vane.

Related objects and advantages of the present invention will be apparent from the drawings and the following description.

DESCRIPTION OF SELECTED EMBODIMENTS

Figure 1:
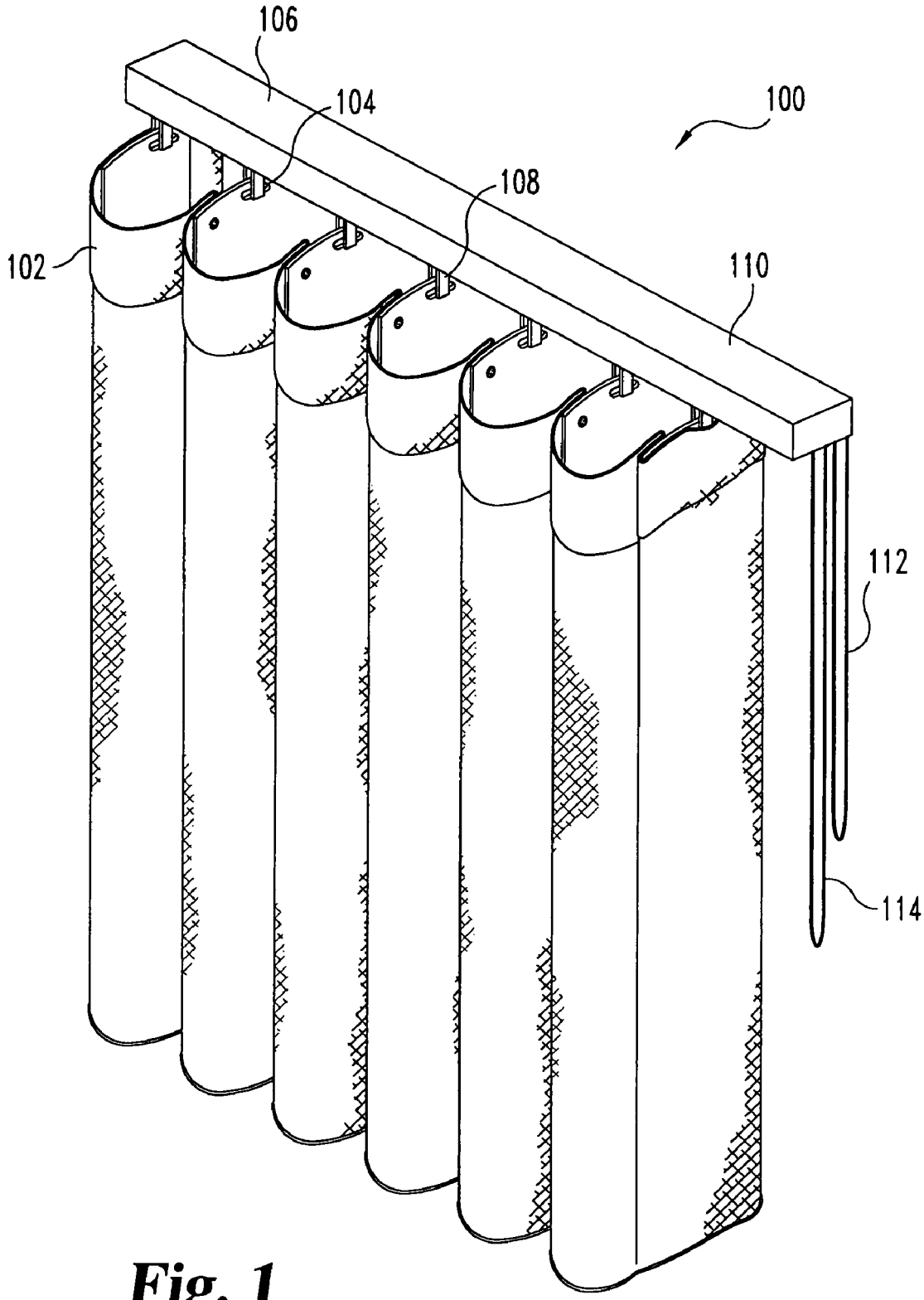
FIG. 1 is a perspective view of a vertical blind system with a vane cover according to one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity. The drawing in which an element first appears is typically indicated by the left-most character(s) and/or digit(s) in the corresponding reference number.

FIG. 1 illustrates a vertical blind cover system 100 according to one embodiment, of many, of the present invention. AF illustrated, system 100 includes a detachable vane cover 102 detachably coupled to vanes 104 and a vane mechanism 106 that supports the vanes 104. The vane mechanism 106 includes moveable carrier shafts or clips 108 to which the vanes 104 are attached, and the clips 108 are slidably received in a rail or housing 110. A move pulley 112 in the vane mechanism 106 is operatively coupled to the carrier clips 108 in order to move the vanes 104 laterally along the housing 110. A rotate pulley 114 is operatively coupled to the carrier clips 108 in order to rotate the vanes 104 into open or closed positions. As should be appreciated other type of mechanisms, such as rotatable rods and the like, can be used instead of pulleys 112 and 114 in order to operate the vane mechanism 106. The vanes 104 can be made of rigid or semi-rigid material such as plastic or metal. In one embodiment, the vanes 104 are made of a semi-rigid plastic.

Figure 2:
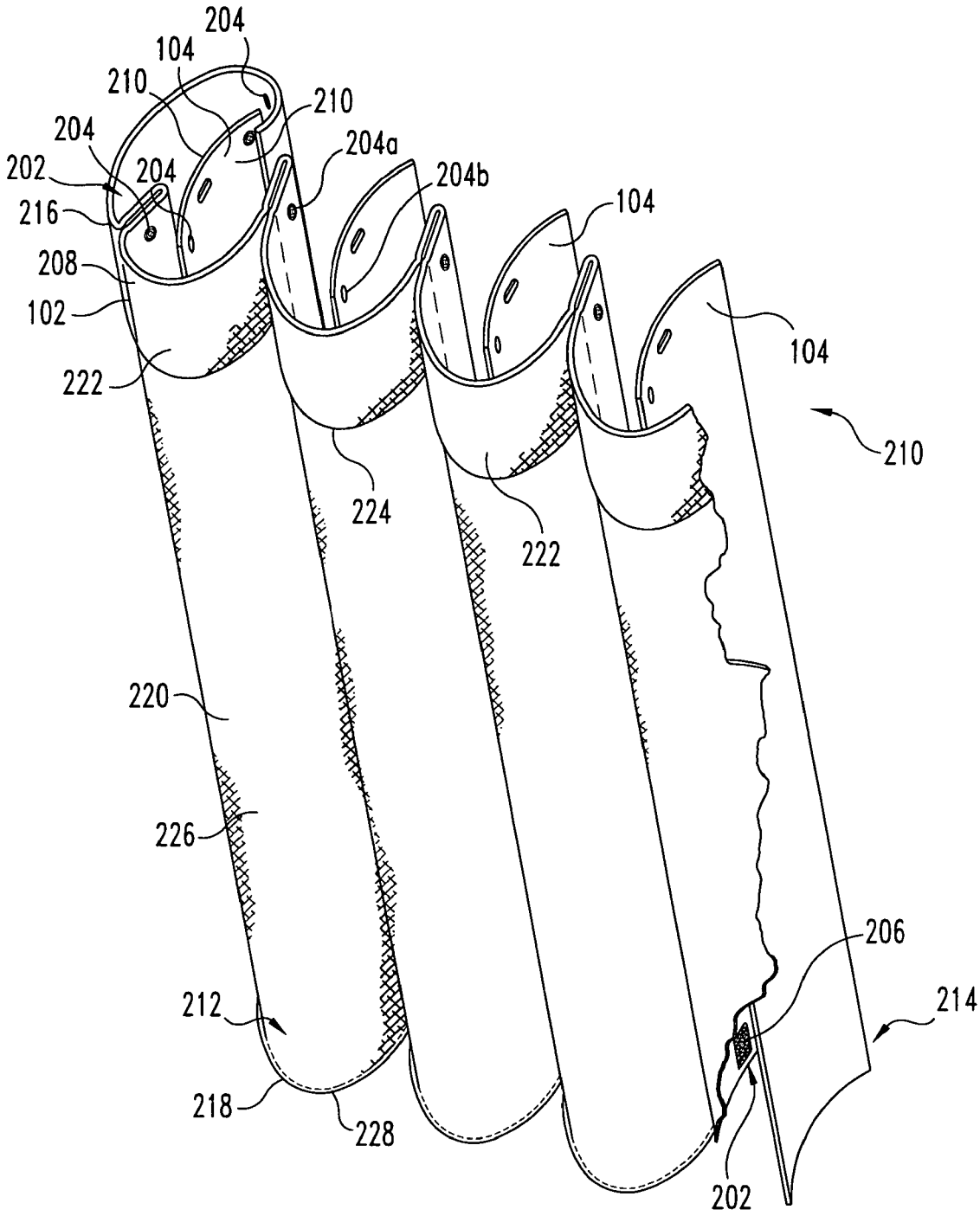
FIG. 2 shows an exploded view of the vane cover and vanes of the FIG. 1 system.

As illustrated in FIG. 2, the cover 102 is coupled to the vanes 104 with reattachable (detachable) fasteners 202. The reattachable fasteners 202 allow the cover 102 to be repeatedly removed and reattached to the vanes 104 without significantly marring and/or destroying the vanes 104. With reattachable fasteners 202, the cover 102 can be easily removed for cleaning or replaced with a different cover 102 in order to change a room's decor. The reattachable fasteners 202 can include snap type fasteners, VELCRO® brand type fastening strips (hereinafter "Velcro") and other types of reattachable fasteners, to name a few. It should be appreciated that while "Velcro" is a brand name, the term "Velcro" as used herein is not intended to limit the present invention to a specific brand or manufacturer of reattachable plastic hook and loop filament strips, but rather, is being used to connote the common generic usage of the term. In the illustrated embodiment, the fasteners 202 include snap fasteners 204 and Velcro strips 206 that are used to detachably secure the cover 102 to the vanes 104. As depicted, upper portion 208 of the cover 102 is secured to upper portion 210 of the vanes 104 with mating snap fasteners 204, and lower portion 212 of the cover 102 is secured to lower portion 214 of the vanes 104 with mating Velcro strips 206. Such a construction assures that upper edge 216 of the cover 102 appears straight to a viewer; while at the same time allowing greater flexibility in positioning the lower portion 212 of the cover 102 where straightness of lower edge 218 of the cover 102 is not as critical. Further, the Velcro strips 206 along with the rigidity of the vanes 104 allow the cover 102 to be placed in tension in order to reduce any wrinkling in the cover 102. It was discovered that the cover 102 only needed to be secured at the upper 210 and lower 214 portions of the vanes 104 in order to provide a wrinkle free appearance. However, it should be understood that additional fasteners 202 can be added along the cover 102 and the vanes 104. In one embodiment, the Velcro strips 206 are separately glued to both the cover 102 and the vanes 104, and in another embodiment, the Velcro strips 206 are sewn onto the cover 102. In one embodiment, the cover 102 has male snaps 204*a* and the vanes 104 have corresponding female snaps 204*b*. As should be appreciated, the cover 102 can have female snaps 204*b* or a combination of male and female snaps 204. Furthermore, it should be appreciated that all or portions of the fasteners 202 can be integrally formed in the cover 102 and the vanes 104.

The cover 102 is made of a washable fabric so that the cover 102 can be removed from vanes 104 and washed in a conventional (water based) washing machine without being ruined. For example, this washable fabric can include, but is not limited to, natural fabrics such as cotton and artificial fabrics such as nylon and polyester, to name a few. In the embodiment illustrated in FIG. 2, the cover 104 includes a sheer type fabric portion 220 that is made of a sheer type washable fabric and a generally opaque stiffening (backing) fabric strip 222 that is sewn inside the sheer fabric at the upper portion 208 of the cover 102 (see FIG. 7). As should be appreciated, the stiffening strip 222 can be attached to the sheer type fabric in other manners, such as by gluing strip 222 to the sheer fabric. The sheer fabric portion 220 diffuses the light that shines through the vanes 104 when the vanes 104 are in an opened position. The sheer fabric is folded over the stiffening fabric strip 222 and sewn at a bottom edge portion 224 of the stiffening strip 222. Due to the opaque (or semi-opaque) nature of strip 222, the stiffening strip 222 hides the clips 108 and the snaps 204 from view. Moreover, the stiffening strip 222 helps form and maintain the outward facing, u-shaped or scalloped folds 226 in the cover 102. At the lower portion 212 of the cover 102, the cover has a hemmed portion 228.

Figure 3:
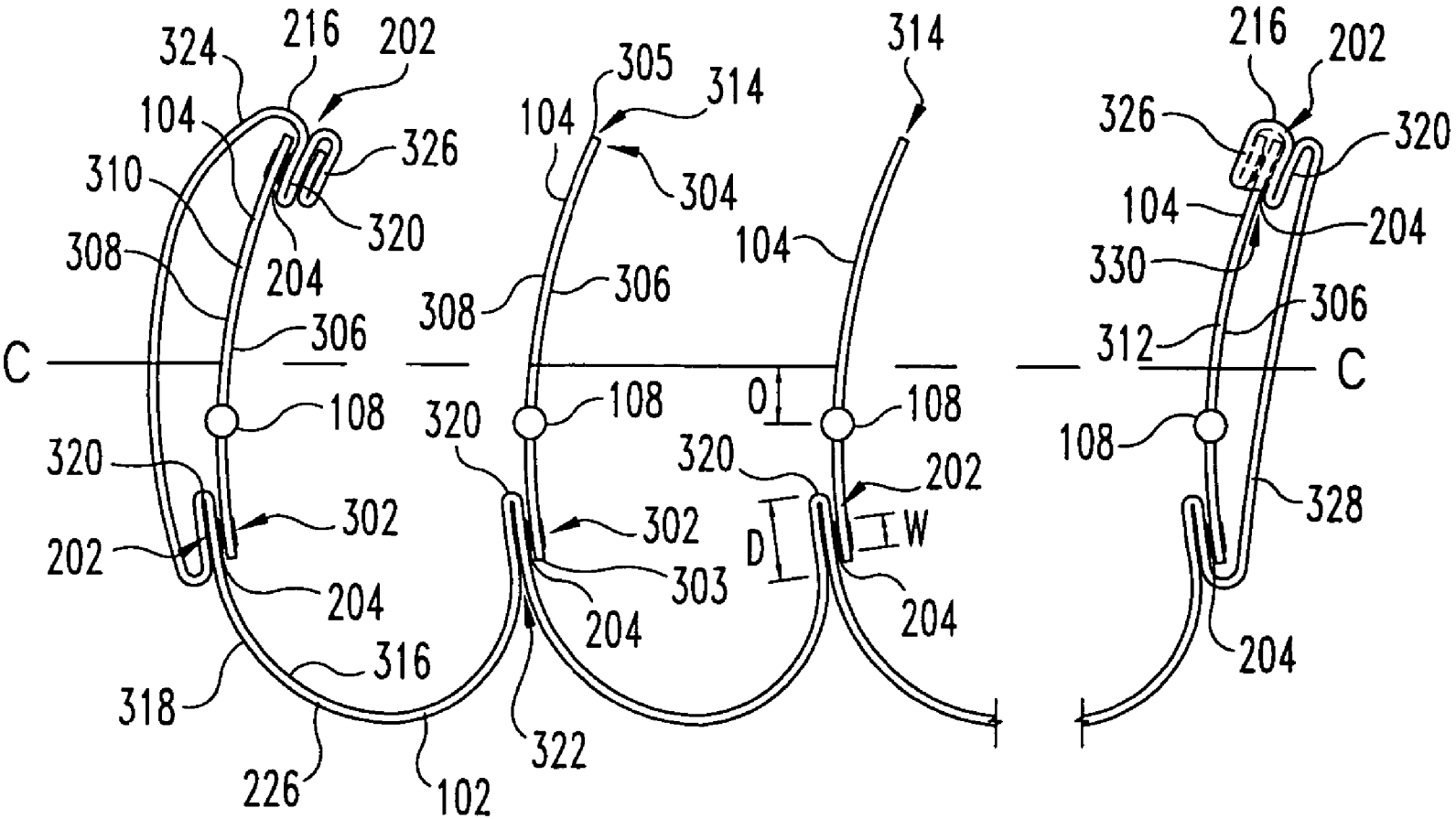
FIG. 3 shows a top, cross sectional view of the vane cover attached to the vanes in the FIG. 1 system.
Figures 4A, 4B, 5A, 5B, 6A, 6B:
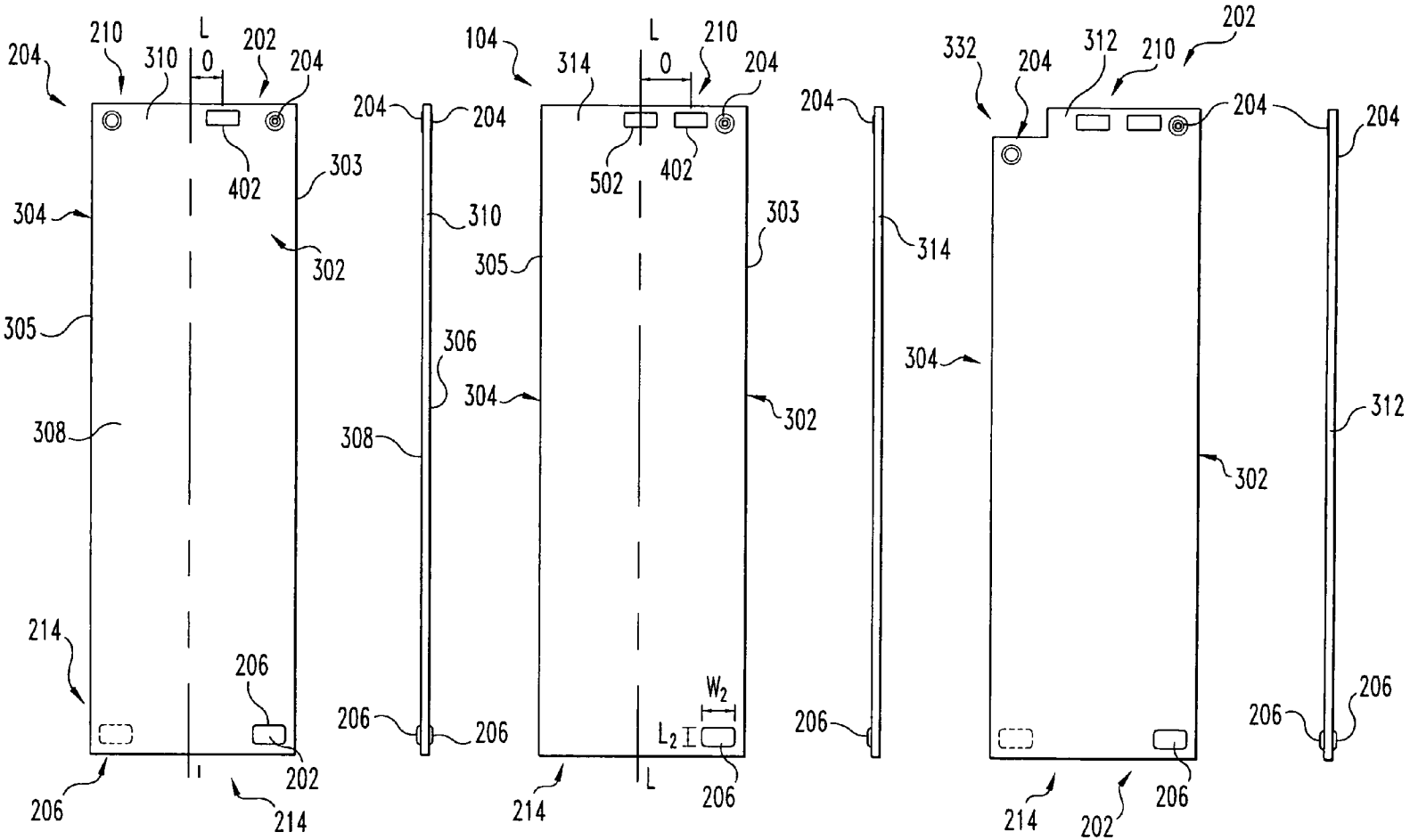
FIG. 4A shows a side view of a first end vane in the FIG. 1 system.
FIG. 4B shows a front view of the first end vane.
FIG. 5A shows a side view of a middle vane in the FIG. 1 system.
FIG. 5B shows a front view of the middle vane.
FIG. 6A shows a side view of a second end vane in the FIG. 1 system.
FIG. 6B shows a front view of the second end vane.
Figure 7:
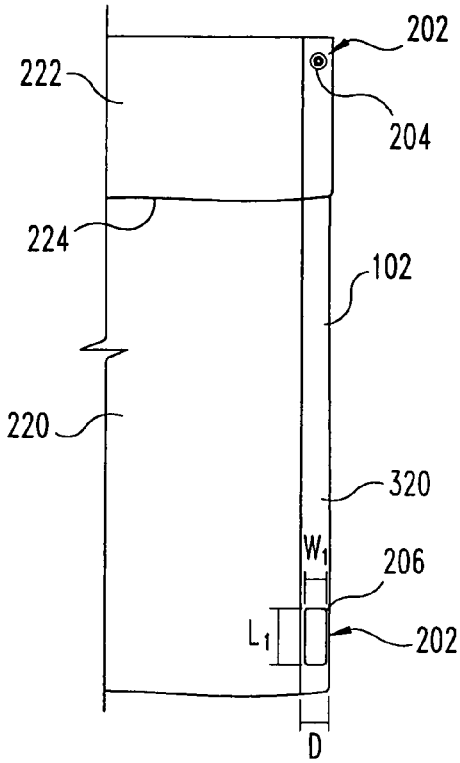
FIG. 7 shows a partial side view of the vane cover.

As shown in greater detail in FIGS. 3–6, the vanes 104 include an inboard (inside) edge portion 302 located proximal along inboard edge 303 and an opposite outboard (outside) edge portion 304 located proximal along outboard edge 305. When the vanes are in an opened position, the inboard edge 303 generally faces the viewer (room occupant), and the outboard edge 305 generally faces an opening, such as a window. The vertical blind cover system 100 according to the present invention allows the cover 102 to be easily retrofitted to and/or attached/removed from vanes 104 that have a bowed shaped. In the illustrated embodiment, the vanes 104 have a bowed shape. Between the edge portions 302 and 304, the vanes have a first surface 306 that has a concave shape and a second surface 308 that has a convex shape. The vanes 104 include a first end vane 310, a second end vane 312, and one or more middle vanes 314 located between the first 310 and second 312 end vanes. In the illustrated embodiment, the vane cover 102 is formed from a continuous sheet of fabric, which reduces the manufacturing cost of the cover 102. As mentioned above, in one embodiment, the cover 102 is made of a sheer type fabric that is folded over and attached to the stiffening strip 222 at the upper portion 208 of the cover 102. In FIG. 3, the cover 102 includes outboard-facing (outside) surface 316 and an opposite, inboard-facing (inside) surface 318. For each vane 104, the outboard-facing surface 316 of the cover 102 has at least one closed pleat 320 at which one or more fasteners 202 are attached. As shown, pleat 320 is closed at connection portion 322 and extends the entire length of the cover 102 from upper portion 208 to lower portion 210. In one form, the fabric is sewn together at the connection portion 322, and in another form, the fabric at portion 322 is glued together. It should be understood that the fabric can be joined together in other generally known manners in order to form the closed pleat 320. To conserve fabric, the closed pleat 320 in one form does not extend the full width of the vane 104; rather, the closed pleat 320 has a depth D that is equal to or slightly greater than width W of the fastener 202. In one embodiment, as shown in FIG. 7, the Velcro strip 206 has a width W1 that is approximately equal to the depth D of the closed pleat 320. In order to allow the position of the lower portion 212 of the cover 102 to be adjusted in multiple directions while at the same time reducing the amount of Velcro strips 206 used, the Velcro strip 206 on the vanes 104 (FIG. 5A) has a length L2 that is less than length L1 of the Velcro strip 206 on the cover 102 and a width W2 that is greater than width W1 of the Velcro strip 206 on the cover 102. When mated together the perpendicularly oriented Velcro strips 206 on the cover 102 and the vane 104 form a cross pattern such that the lower portion 212 of the cover 102 can be both vertically and horizontally repositioned.

At the first end vane 310, the cover 102 has a first end portion 324 that covers the convex surface (side) 308 of the first end vane 310. As shown in FIGS. 3 and 4A–B, the cover 102 at portion 324 wraps around the outboard end 305 of the vane 104 and is attached by fasteners 202 to the concave surface 306 at the outboard end portion 304. In the illustrated embodiment, the fasteners 202 on the concave surface 306 of the first end vane 310 are snap fastener 204 at the upper portion 210 and Velcro strip 206 at the lower portion 214. Both the snap fastener 204 and the Velcro strip 206 are secured to pleat 320 and finishing pleat 326 is attached at the upper edge 216 to pleat 320 in order to hide the backside of the snap fastener 204 so as to provide a finished appearance.

As shown in FIGS. 3–6, the convex surface 308 of each vane 104 has fasteners 202 at their respective inboard edge portions 302. In the particular illustrated embodiment, the convex surface 308 has snap fastener 204 at the upper portion 210 and Velcro strip 206 at the lower portion 214. It should be understood that fasteners 202 on the vanes 104 can be flush with the edges of the vanes 104 and/or can be slightly offset from the edges of the vanes 104. It was discovered that placing the fasteners 202 on the convex surface 308, as opposed to the concave surface 306, of the inboard edge portion 302 of the vanes 104 made removal and reattachment of the cover 102 easier. One of many factors that made the convex surface 308 a more desirable location was that the convex surface 308 provided greater visibility for the fastener 202 as compared to the concave surface 306 so that an installer does not have to "blindly" attach the fasteners 202.

At the second end vane 312, the cover 102 has a second end portion 328 that covers the concave surface 306 of the second end vane 312. As shown in FIG. 3, the cover 102 at the second end portion 328 has pleat 320 to which fastener 202 is attached and finishing pleat 326. The finishing pleat 326 is attached at the upper edge 216 to the closed pleat 320 so as to form a pocket 330 in which the outboard end portion 304 of the second end vane 312 is received. As shown, the fastener 202 on the closed pleat 320 faces the finishing pleat 326 and engages the fastener 202 on the concave side 306 of the second end vane 312. As should be appreciated two pleats 320 can be used to secure the cover 102 at the inboard edge portion 302 of the vane 104. In one form of the present invention, the cover 102 can have closed pleat 320 and finishing pleat 326 with each having a fastener 202 in order to secure the cover 102 to the inboard edge portion 302 of the same vane 106 on opposite sides 306 and 308 of the vane 106. In the embodiment illustrated in FIGS. 6A and 6B, the outboard edge 304 of the second end vane 312 has a snap fastener 204 at the upper edge portion 210 and a Velcro strip 206 at the lower edge portion 214. As illustrated in FIG. 6, the outboard edge portion 304 of the second end vane 312 has a notch 332 formed at the upper edge portion 210. The pocket 330 of the cover 102 is received over the notch 332, and the notch 332 ensures that the upper edge 216 of the cover 102 is level. As should be appreciated, the pocket 330 and notch 332 construction can be used to secure the cover 102 to the inboard edge portion 302 of the vane 104. In another form, the first end vane 310 has notch 332 defined therein such that the first 310 and second 312 end vanes are the same in order to reduce the number of components.

As depicted in FIGS. 3–5, the carrier clips 108 are attached the to the vanes 104 at an offset distance O from a center plane C formed by longitudinal centerlines L of the vanes 104. As shown, the carrier clips 108 are offset towards the inboard edge portion 302 of the vanes 104 in order to counter-balance the cover 102 when attached to the vanes 104. Referring to FIG. 4A, an offset clip opening 402 to which the clips 108 are attached is offset distance O from the centerline L of the vane 104 toward the inboard edge portion 302 in order to reduce the amount of back swooping in the cover 102 when attached to the vanes 104. As shown in FIG. 4A, the vane 104 can be prefabricated with a single offset clip opening 402. Alternatively, as shown in FIG. 5A, the offset clip opening 402 can be formed in a vane that has a pre-existing centered clip opening 502.

Figure 8:
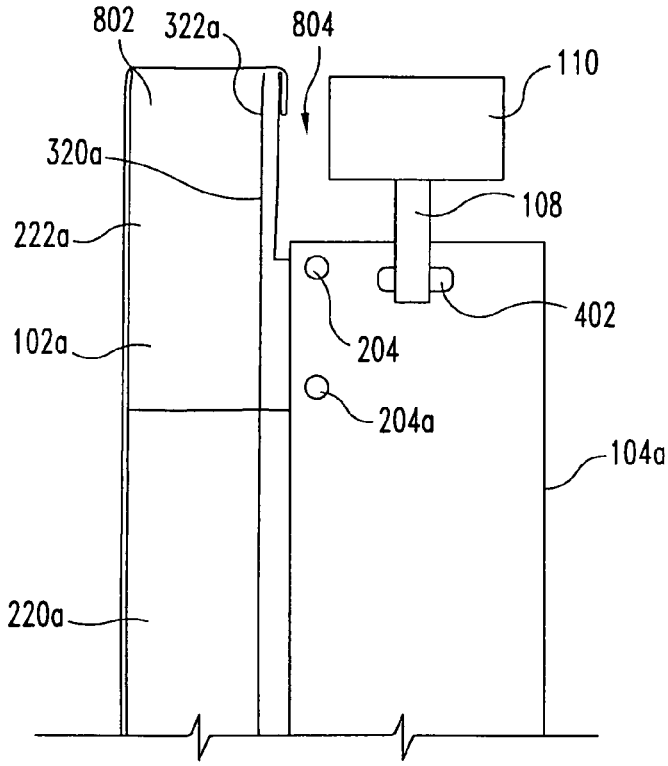
FIG. 8 shows a partial cross sectional side view of a vertical blind system according to another embodiment of the present invention.

A cover 102*a* according to another embodiment of the present invention is illustrated in FIG. 8. In the illustrated embodiment, cover 102*a* has an extension portion 802 that hides housing 110 from view, and the extension portion 802 includes a stiffening strip 222*a*. To minimize puckering of the stiffening strip 222*a*, cover 102*a* and vane 104*a* have a second snap fastener 204*a* located below snap fastener 204 along the stiffening strip 222*a*. In one form, snap fastener 204*a* is located approximately two-inches (2") below snap fastener 204 along the inboard edge portion 302 of the vane 104*a*. Below stiffening strip 222*a*, the cover 102*a* has a sheer fabric portion 220*a*. In extension portion 802, a housing notch 804 is formed in closed pleat 320*a* in order to accommodate the housing 110. As depicted in FIG. 8, connection portion 322*a* closes the closed pleat 320*a* at housing notch 804.

Another feature of the present invention is that the reattachable cover 102 can be easily and inexpensively retrofitted to conventional vertical blind systems. Initially, vane 104, as shown in FIG. 5A, has central clip opening 502 at which the vane 104 is originally suspended from the carrier clips 108. The vanes 104 are removed from the carrier clips 108, and the offset clip openings 402 are formed offset distance O from the centered clip openings 502. In one form, the offset clip opening 402 is formed by punching opening 402 into the vane 104. As should be appreciated, additional offset clip openings 402 can be formed so that the vane 104 can support covers 102 of differing weight and size. Notch 332 is also formed in the second end vane 312. The fasteners 202 are attached to the vanes 104 at the locations described above. In one form, the fasteners 202 are glued to the vanes. Alternatively or additionally, the snap fasteners 204 can be attached by pressingly engaging the vane 104 between an o-ring and body of the snap fastener 204. After the fasteners 202 are secured to the vanes 104, the vanes 104 can be re-hung on the carrier clips 108 by the offset clip openings 402.

In one embodiment, the cover 102 is created by folding sheer type fabric over the stiffening strip 222 and securing the fabric to the stiffening strip in the manner as described above. In one form, the sheer fabric is sewn to the stiffening strip 222. Pleats 320 and 324 are formed on the cover and fasteners 202 are attached the closed pleats 320 at positions corresponding to their respective mating fasteners 202 on the vanes 104. Next, the fasteners 202 of the cover 102 are attached to the fasteners 202 on the vanes 104 such that the u-shaped folds 226 are formed. At a later time, the cover 102 can be removed for cleaning or replaced with a differently styled cover 102. While the cover 102 is being cleaned, the vanes 104 can be hung on the carries 108 by their original central clip openings 502. This ensures that the vanes 104 are balanced and operate properly when the cover 102 is not attached. Before the cover 102 is reattached, the vanes 104 can again be hung by the offset clip openings 402.

Figure 9:
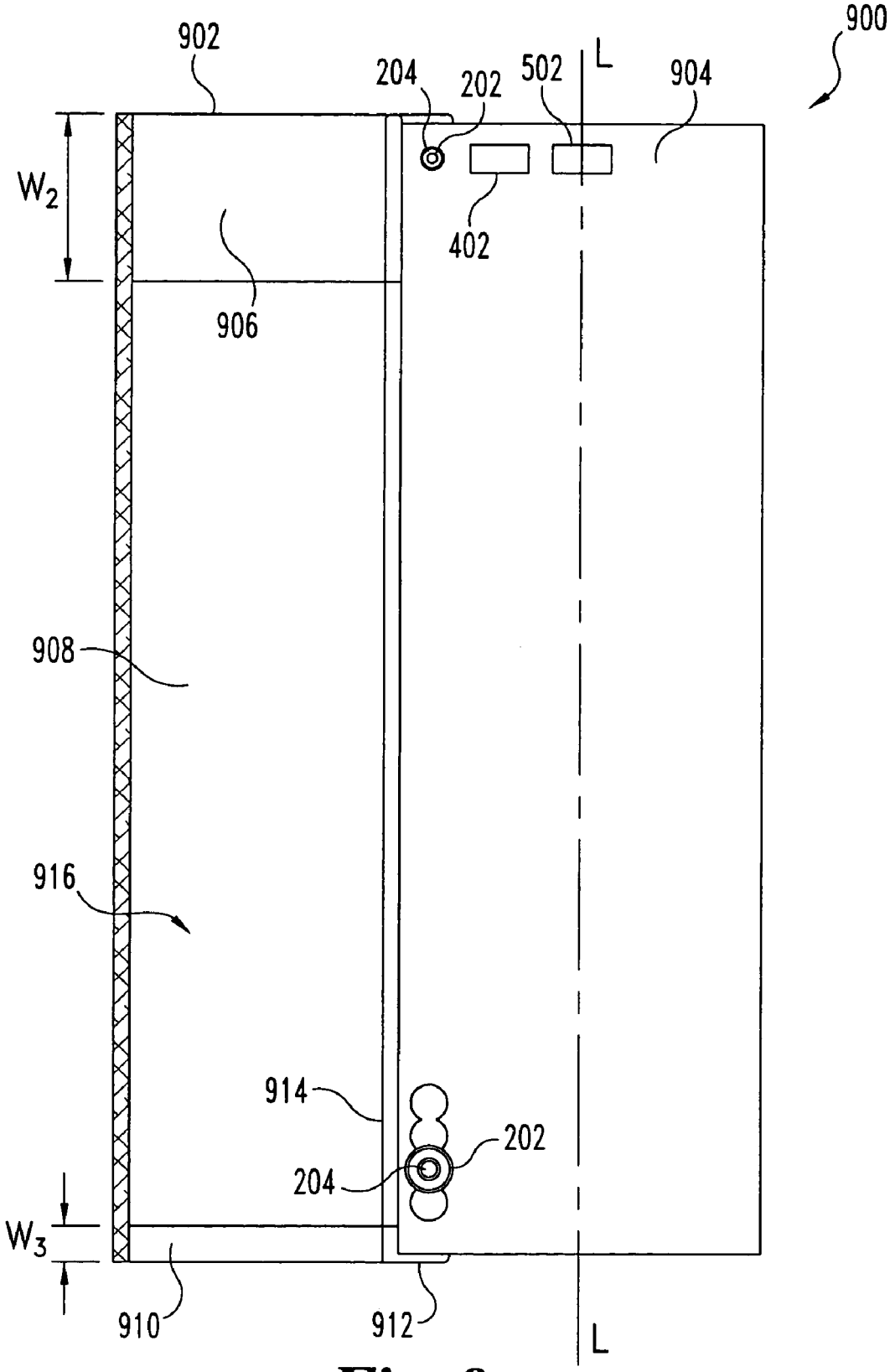
FIG. 9 shows a partial cross sectional side view of a vertical blind system according to a further embodiment of the present invention.
Figure 10:
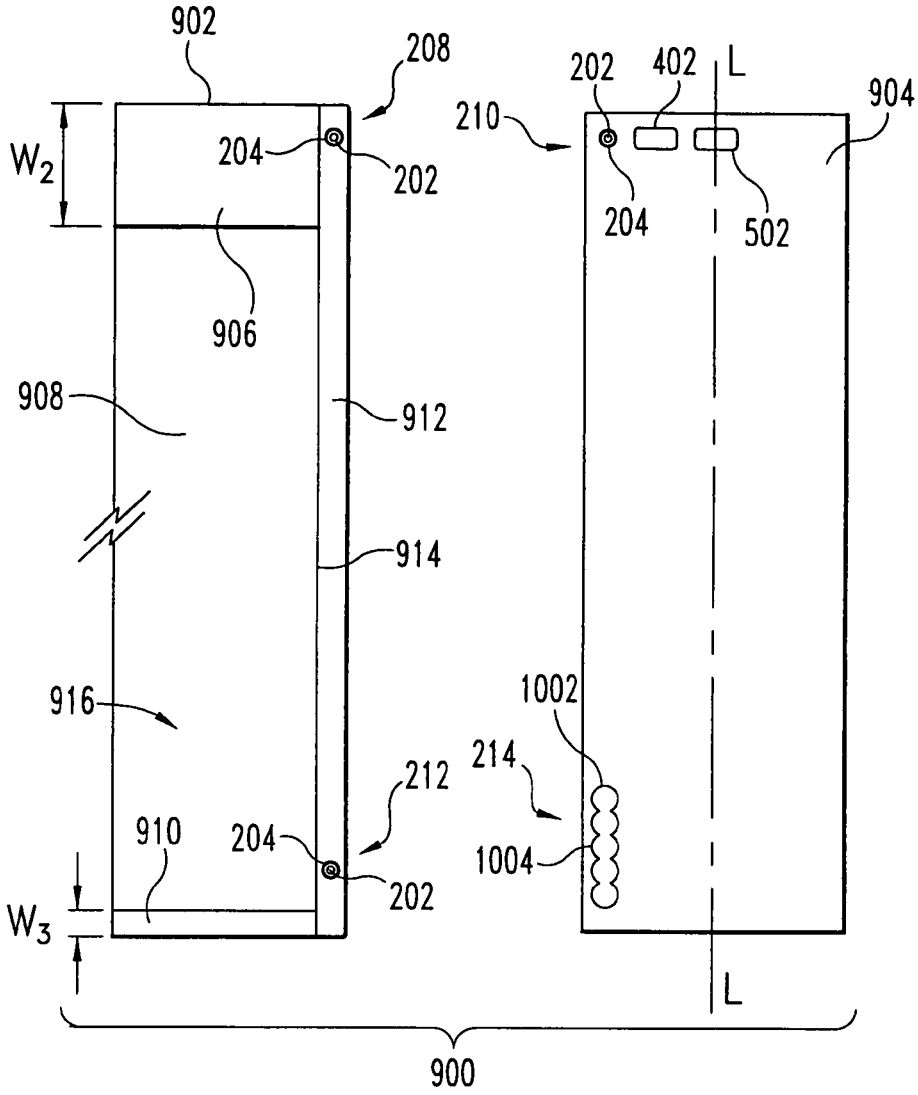
FIG. 10 shows an exploded view of the FIG. 9 blind system.
Figure 11:
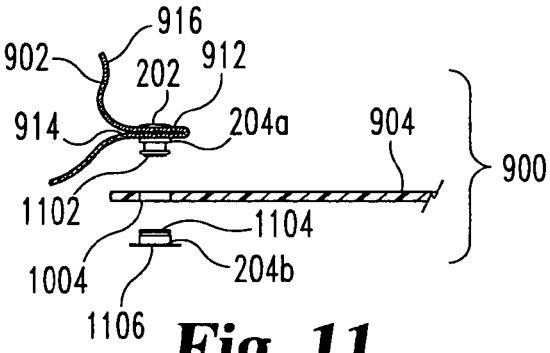
FIG. 11 shows a cross sectional view a cover and vane in the FIG. 9 blind system before the cover is attached to the vane.

As mentioned above, variations in the length of vanes and covers can make installation of vane covers difficult. If not properly installed, the vane cover can appear wrinkled, which is typically undesirable. A vertical blind cover system 900 according to another embodiment of the present invention, which simplifies the installation process and allows for the removal of wrinkles, is illustrated in FIGS. 9 and 10. Similar to the previous embodiments, the vertical blind cover system 900 includes a detachable vane cover or curtain 902 that is detachably coupled to one or more vanes 904. Like before, the vanes 904 can be bowed or straight, and can have clip openings 402, 502 for securing the vanes 904 to a vane mechanism. Although not shown in FIG. 9, it should be appreciated that the vane mechanism 106 of the type as described above can be used to move and rotate the vanes 904. The vertical blind system 900 in FIG. 9 is configured to allow the position of the vane cover 902 to be adjusted after the vane cover 902 is attached to the vane 904 without the need to detach and reattach the vane cover 902. Once the vane cover 902 is secured, the installer can simply pull on the vane cover 902 in order to reduce wrinkling of the vane cover 902 so as to provide a clean appearance. If so desired, the installer can also adjust the vane cover 902 so as to create folds or wrinkles.

The vane cover 902 in FIG. 9 incorporates a number of features that simplify manufacturing of the vane cover system 900 and make the vane cover 902 easier to clean. At its upper portion 208, the vane cover 902 includes an upper section 906 that is in the form of a strip that extends transversely to longitudinal axis L. An intermediate section 908 is positioned between the upper section 906 and a lower section 910. As shown, the lower section 910 is in the form of a strip that extends transversely to the longitudinal axis. Although the sections 906, 908, 910 of the cover 902 illustrated in FIG. 9 are generally straight, it should be appreciated that these sections can be shaped differently so as to be curved and/or patterned, for example. Similar to the previous embodiments, the cover 902 has one or more pleats 912 that generally extend parallel to the longitudinal axis L of the vane 904. At connection portion 914, the cover 902 is joined together to form the pleat 912. In the illustrated embodiment, the cover 902 is formed from a continuous sheet of fabric, but it is envisioned that the cover 902 in other embodiments can be formed from separate sheets of fabric. Between the pleats 912, u-shaped or bowed sections 916 of the cover 902, like those illustrated in FIGS. 1 and 3, extend from the vanes 904. As shown in FIG. 10, the reattchable fasteners 202 are secured along the pleats 912 so that the cover 902 can be attached to the vanes 904 at the pleats 912.

In the illustrated embodiment, the upper section 906 is made of selvedge material that is generally opaque to hide the vane mechanism 106 as well as other parts from view, and due to the stiffness of the selvedge material, the upper strip 906 also acts as a stiffening strip so that the cover 902 maintains its outwardly bowed appearance. Likewise, the lower strip 910 is made of selvedge material so as to provide a clean edge as well as provide some structural stiffness to maintain the overall shape of the cover 902. The intermediate section 908 is made from non-selvedge material, which in the illustrated embodiment is semi-transparent, but in other embodiments, the intermediate section 908 can be transparent or opaque. The selvedge material in the upper 906 and lower 910 sections has a higher thread count, heavier threads, different thread types, and/or a different weave than the material that forms the intermediate section 908. In the illustrated embodiment, the upper 906, intermediate 908 and lower 910 sections are part of a continuous sheet of fabric that has sections with selvedge material characteristics, and the selvedge material in the upper 906 and lower 910 sections has a higher thread count than the non-selvedge material in the intermediate section 908. However, it should be understood that selected sections can be sown or joined in other manners so as to form the cover 902 in other embodiments.

Using selvedge material in the upper 906 and lower 908 sections eliminates the need for any type of backing material, such as a stiffening strip, and/or folded-over seams in the cover 902, which in turn simplifies manufacturing of the cover 902. Cleaning or washing of vane covers with stiffening strips can be difficult because the stiffening strips are prone to damage during cleaning. For example, the stiffening strip can become folded and creased, and removing the creases can be difficult at best. By utilizing selvedge material in place of the stiffening strip, the cover 902 according to the illustrated embodiment can be easily cleaned in a conventional manner. Even if the selvedge material becomes creased, the creases can be easily removed with an iron, for example. Moreover, as depicted in FIG. 10, the selvedge material in the upper section 906 of the cover 902 reduces or eliminates any puckering or wrinkles around the snap fasteners 204 or seams in the cover 902. In another embodiment, the snap fastener 204 near the lower portion 212 of the cover 902 is attached to the lower section 910 so as to reduce any puckering around the snap fastener 204.

Depending on the desired appearance, the selvedge material of the upper section 906 normally has a width W2 greater than one inch (1"), and in one embodiment, the width W2 of the selvedge material at the upper section 906 is anywhere from about one and a half to five inches (1½"–5"). The lower section 910 in one embodiment has a width W3 that is about less than one inch (1"). Nonetheless, the width of the upper 906 and lower 910 sections of the cover 902 can be different in other embodiments. As should be appreciated, the selvedge material in the cover 902 simplifies manufacturing of the cover 902 and makes cleaning of the cover 902 easier.

With reference to FIG. 10, the cover 902 is coupled to the vane 904 with reattachable fasteners 202. In the illustrated embodiment, the reattachable fasteners 202 include snap fasteners 204 that are used to detachably secure the cover 102 to the vanes 104. As depicted, upper portion 208 of the cover 902 is secured to upper portion 210 of the vanes 904 with mating snap fasteners 204. The lower portion 212 of the cover 902 has a snap fastener 204 that is detachably secured to the lower portion 214 of the vane 904. As shown, the lower portion 214 of the vane 904 has an adjustment slot 1002 formed by a series of fastener openings 1004. In the adjustment slot 1002, adjacent fastener openings 1004 open into one another to permit movement of the snap fastener 204. In the illustrated embodiment, the adjustment slot 1002 has five (5) fastener openings, but it should be appreciated that the adjustment slot 1002 can include more or less fastener openings 1004 than is shown. For instance, the adjustment slot 1002 in other embodiments can include two (2) or more fastener openings 1004. In one form, the fastener openings 1004 are punched into the vane 904, and in another form, the fastener openings 1004 are formed during molding of the vane 904. However, it should be appreciated that the fastener openings 1004 can be formed in other manners.

Figure 12:
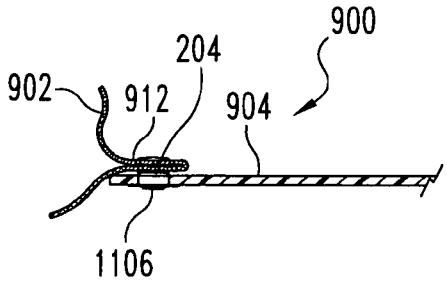
FIG. 12 shows a cross sectional view the FIG. 11 cover and vane once the cover is attached to the vane.
Figure 13:
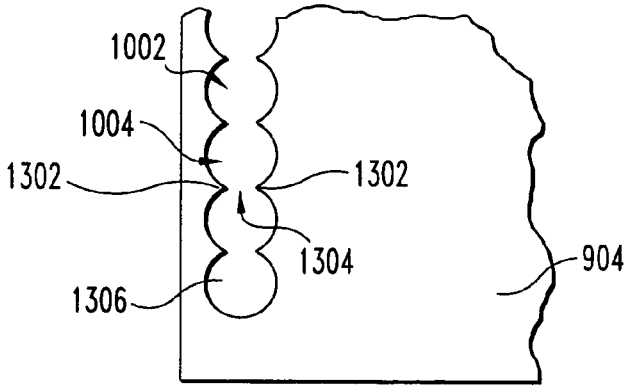
FIG. 13 shows a side view of an adjustment slot in the FIG. 11 vane.

FIGS. 12 and 13 illustrated how the lower portion 212 of the cover 902 is secured to the lower portion 214 of the vane 904. In the embodiment shown, the lower portion 212 of the cover 902 has a male snap 204*a* with a stud 1102. Nevertheless, it should understood that the cover 902 in other embodiments can have female snaps 204*b*, or a combination of male and female snaps 204*b*. Initially, the female snap 204*b* of the snap fastener 204 is separate from the male snap 204*a*. Although the female snap 204*b* is illustrated as being initially separate from the other components, it should be appreciated that selected portions of the fasteners 202 can be integrally formed with the cover 902 and/or the vanes 904.

For example, it is contemplated that each pleat 912 of the cover 902 can include two flaps in which one of the flaps has the male snap 204*a* and the other flap has the female snap 204*b*. When secured, the male 204*a* and female 204*b* snaps are snapped together in the adjustment slot 1002 with the edge of the vane 904 sandwiched between the two flaps. In another embodiment, the female snaps 204*b* are integrally attached to the vane cover 902, and the male snaps 204*a* are initially separate from the vane cover 902. To attach the lower portion 212 of the cover 902, the stud 1102 of the male snap 204*a* is inserted into one of the fastener openings 1004, and the stud 1102 is snapped into socket 1104 of the female snap 204*b*. As shown, the female snap 204*b* has a retainer cap or flange 1106 that is larger than the fastener openings 1004, thereby preventing the snap fastener 204 from being pulled out of the adjustment slot 1002. The snap fasteners 204 are sized small enough to have a portion fit inside the openings 1004, but the snap fasteners 204 are large enough to prevent the snap fasteners 204 from being easily slid into the adjacent openings 1004.

As shown in FIG. 13, the adjustment slot 1002 has a pair of retention arms 1302 located between adjacent fastener openings 1004 for retaining the snap fastener 204 in position. Although a pair of retention arms 1302 are illustrated, it should be understood that the adjustment slot 1002 can have more or less retention arms 1302 between adjacent fastener openings 1004 than is shown. For instance, a single retention arm 1302 can be positioned between adjacent fastener openings 1004. In the illustrated embodiment, a passage gap 1304 is formed between the ends of the retention arms 1302 that allows movement of the snap fastener 204 when the vane cover 902 is pulled (or the snap fastener 204 is pushed). The passage gap 1304 is sized smaller than the stud 1102 and/or socket 1104 of the snap fastener 204 so as to retain the snap fastener 204 in the fastener opening 1004. Although the ends of the retention arms 1302 in the illustrated embodiment are spaced apart from one another, it is contemplated that the ends of retention arms 1302 in other embodiments can normally contact one another and are able to separate to allow passage of the snap fastener 204. To allow passage of the snap fastener 204, the retention arms 1302 are resilient. As the snap fastener 204 moves when the cover 902 is adjusted, the retention arms 1302 bend, and in so doing, allow passage of the snap fastener 204 from one opening 1004 to the next. Once the snap fastener 204 is pulled through, the retention arms 1302 return to their original undeflected position, thereby retaining the snap fastener 204 in the opening 1004. In FIG. 13, the fastener openings 1004 form a series of retention cavities 1306 in which the snap fastener 204 can be retained. The illustrated fastener openings 1004 as well as the retention cavities 1306 have a generally circular shape so as to coincide with the shape of the snap fasteners 204, but it should be appreciated that the fastener openings 1004 and the retention cavities 1306 can be shaped differently. For instance, the fastener openings 1004 can be rectangular in shape or can be shaped like bayonet style openings in order to hold the fasteners 204 in place.

In the embodiment illustrated in FIG. 10, the fastener openings 1004 are positioned so that the adjustment slot 1002 extends in a generally parallel manner relative to the longitudinal axis L of the vane 904. It is contemplated that in other embodiments the adjustment slot 1002 can be oriented in other manners so as to permit adjustment of the vane cover 902 in other directions. For example, the adjustment slot 1002 can be angled relative to the longitudinal axis L to permit adjustments both in lengthwise and crosswise directions. Although the illustrated embodiment shows that each vane 904 only has a single retention slot 1002, it should be appreciated that each vane 904 can include more than one retention slot 1002. Moreover, it is envisioned that the retention slot 1002 can be positioned at other locations. For example, the adjustment slot 1002 can be positioned at the upper portion 210 of the vane 204 to allow adjustment of the upper portion 208 of the cover 902.

Figure 14:
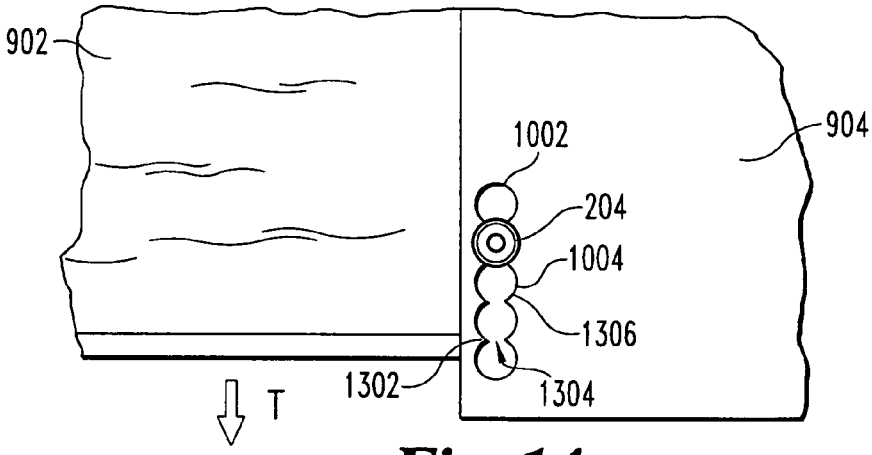
FIG. 14 shows a partial cross sectional side view of the FIG. 11 cover attached to the vane when the cover is loose.
Figure 15:
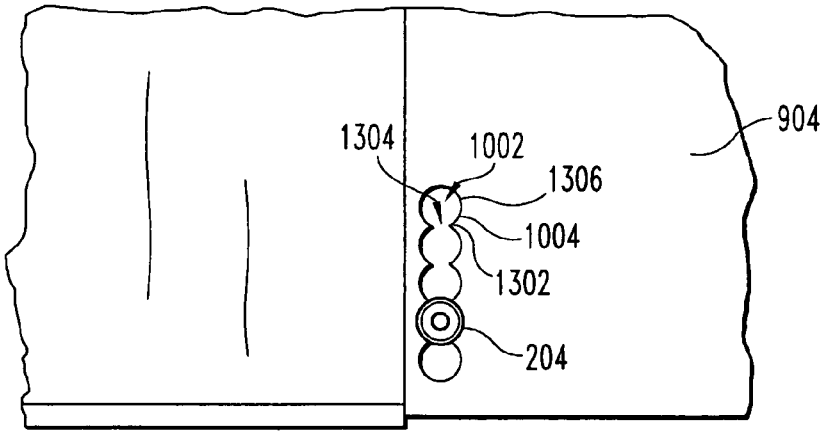
FIG. 15 shows a partial cross sectional side view of the FIG. 11 cover attached to the vane when the cover is tight.

As mentioned above, the interface between the snap fastener 204 and the adjustment slot 1002 along with the rigidity of the vanes 904 allow the cover 902 to be placed in tension in order to reduce any wrinkling in the cover 902. Referring to FIGS. 14 and 15, after the snap fastener 204 is secured to the vane 904, the cover 902 can be pulled in tightening direction T to remove any wrinkles from the cover 902. As the cover 902 is pulled in direction T, the adjustment slot 1002 acts like a ratchet such that the cover 902 can be retained in the tighter position. Once at the desired position, the cover 902 can be released, and the retention arms 1302 hold the cover 902 in place. If a wrinkled or folded appearance is desired, the cover 902 can be pulled in the opposite direction so as to relieve the tension in the cover 902. As should be appreciated, the cover system 900 of FIG. 9 allows the cover 902 to be adjusted when secured to the vanes 904, without the need for detaching and reattaching the cover 902 from the vanes 904. This makes installation of the cover 902 on the vanes considerably easier. During installation, the installer can first secure the cover 902 to all of the vanes 904 with the snap fasteners 204 secured in the fastener openings 1004 such that the vane cover 902 is generally loose. After the cover 902 is secured to the vanes 904, the installer can step back to see which portions of the cover 902 need to be tightened, and then, the installer can simply pull down on the cover 902 at selected vanes 904 to remove any wrinkles from the cover 902. As mentioned above, the installer can also adjust the vane cover 902 to create a folded or wrinkled appearance when desired.

It is contemplated that other types of retattachable fasteners 202 can be used to secure the vane cover 902 to the vane 904. For example, in another embodiment, buttons are used in place of the snap fasteners 204. In this example, the button is attached to the cover 902 via a stud or a shaft. During installation, the head of the button is slid through the adjustment slot 1002. Once the button is secured to the vane 904, adjustments to the position of the cover 904 can be made by pulling on the cover 902. To hold the button in place, the shaft of the button is sized to engage the retention arms 1302 in the adjustment slot 1002.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. All publications, patents, patent applications, and other documents cited in this specification are herein incorporated by reference as if each individual publication, patent, patent application or document were specifically and individually indicated to be incorporated by reference and set forth in its entirety herein.

What is claimed is:

1. An apparatus, comprising:

a vane defining an adjustment slot; and a vane cover including a first reattachable fastener detachably securing the vane cover to the vane, and a second reattachable fastener detachably secured to the adjustment slot, the adjustment slot being configured to allow adjustment of position of the second reattachable fastener in a ratcheting manner when detachably secured to the adjustment slot.

2. The apparatus of claim 1, wherein the first reattachable fastener is located at an upper portion of the vane cover and the second reattachable fastener is located at a lower portion of the vane cover.

3. The apparatus of claim 1, wherein:

the retention slot includes two or more retention cavities;

the retention slot has at least one retention arm positioned between the two or more retention cavities to retain the second reattachable fastener in one of the two or more retention cavities; and the retention arm is resilient to allow passage of the second reattachable fastener between the two or more retention cavities.

4. The apparatus of claim 3, wherein the two or more retention cavities are generally circular in shape.

5. The apparatus of claim 1, wherein:

the vane has a central longitudinal axis;

the vane defines an offset clip opening from which the vane is hung; and the offset clip opening is offset with respect to the central longitudinal axis.

6. The apparatus of claim 1, wherein the vane cover includes a pleat on which the first reattachable fastener and the second reattachable fastener are secured.

7. The apparatus of claim 1, wherein the vane cover includes:

a first section made of selvedge material; and a second section made of non-selvedge material.

8. The apparatus of claim 7, wherein the selvedge material has a higher thread count than the non-selvedge material.

9. The apparatus of claim 1, wherein the first reattachable fastener includes a snap fastener.

10. The apparatus of claim 1, wherein the second reattachable fastener includes a snap fastener.

11. The apparatus of claim 1, wherein the vane has a longitudinal axis and the adjustment slot extends generally parallel to the longitudinal axis.

12. An apparatus, comprising:

two or more vanes:

a vane cover, wherein the vane cover includes two or more pleats each having a reattachable fastener for detachably securing the vane cover to the two or more vanes, a first section made of selvedge material to maintain shape of the vane cover between the pleats, and a second section positioned adjacent to the first section, wherein the second section is made of non-selvedge material;

wherein the reattachable fastener for each of the two or more pleats is located at an upper portion of the two or more pleats;

wherein the two or more pleats each include a second reattachable fastener detachably secured to the two or more vanes at a lower portion of each of the two or more pleats; and wherein the two or more vanes each define an adjustment slot to which the second reattachable fastener is detachably secured, the adjustment slot in each of the two or more vanes being configured to allow adjustment of the vane cover relative to the two or more vanes in a ratcheting manner.

13. The apparatus of claim 12, wherein the selvedge material has a higher thread density than the non-selvedge material.

14. The apparatus of claim 12, wherein the first section is opaque.

15. The apparatus of claim 12, wherein the adjustment slot has two or more retention cavities separated by at least one retention arm, the retention arm being resilient.

16. The apparatus of claim 15, wherein the second reattachable fastener includes a snap fastener.

17. The apparatus of claim 12, further comprising a vane mechanism from which the two or more vanes are hung.

18. The apparatus of claim 17, wherein the first section of the curtain is positioned to hide the vane mechanism.

19. The apparatus of claim 12, wherein the vane cover includes a third section made of selvedge material.

20. The apparatus of claim 19, wherein the first section is positioned at an upper portion of the vane cover, the third section is positioned at a lower portion of the vane cover, and the second section is positioned between the first section and the third section.

21. The apparatus of claim 12, wherein the vane cover is a continuous sheet of fabric.

22. An apparatus, comprising:

a vane including at least a portion of a reattachable fastener secured to an upper portion of the vane, and wherein the vane defines an adjustment slot having two or more retention cavities separated by at least one retention member.

23. The apparatus of claim 22, wherein the vane is bowed.

24. The apparatus of claim 22, wherein the retention cavities are generally cylindrical in shape.

25. The apparatus of claim 22, wherein the retention member includes a pair of retention arms facing one another.

26. The apparatus of claim 25, wherein the pair of retention arms have ends that are spaced apart to form a passage gap.

27. The apparatus of claim 25, wherein the pair of retention arms contact one another.

28. The apparatus of claim 22, wherein the reattachable fastener includes a snap fastener.

29. The apparatus of claim 22, wherein the vane defines a clip opening from which the vane is hung.

30. The apparatus of claim 29, wherein the vane has a central longitudinal axis and the clip opening is offset from the longitudinal axis.

31. The apparatus of claim 22, wherein the vane has a longitudinal axis and the adjustment slot extends generally parallel to the longitudinal axis.

32. The apparatus of claim 22, wherein reattachable fastener and the adjustment slot are positioned proximal to an edge of the vane.

33. The apparatus of claim 22, wherein the reattachable fastener is positioned at an upper portion of the vane and the adjustment slot is positioned at a lower portion of the vane.

34. An apparatus, comprising:

a vane;

a cover having an upper portion and a lower portion, the upper portion of the cover being coupled to the vane, and the lower portion of the cover being coupled to the vane; and means for permitting positional adjustment of the lower portion of the cover relative to the vane while the lower portion of the cover is coupled to the vane.

35. The apparatus of claim 34, wherein the means for permitting positional adjustment of the lower portion of the cover includes an adjustment slot defined in the vane and a reattachable fastener detachably coupled to the adjustment slot.

36. The apparatus of claim 34, further comprising:

a vane mechanism; and wherein the upper portion of the cover includes selvedge material to hide the vane mechanism.

* * * * *